US011486394B2

(12) United States Patent
Falkus et al.

(10) Patent No.: US 11,486,394 B2
(45) Date of Patent: Nov. 1, 2022

(54) METHOD OF MANUFACTURE OF SCROLL COMPRESSORS AND SCROLL COMPRESSORS MANUFACTURED THEREBY

(71) Applicant: Hanon Systems, Daejeon (KR)

(72) Inventors: Erik-Florian Falkus, Burscheid (DE); Kadir Dursun, Hürth (DE); Frau Susana Salvador, Azeitao (PT); Nuno Guerin, Cascais (PT)

(73) Assignee: Hanon Systems, Daejeon (KR)

( * ) Notice: Subject to any disclaimer, the term of this patent is extended or adjusted under 35 U.S.C. 154(b) by 25 days.

(21) Appl. No.: 16/758,476

(22) PCT Filed: Oct. 17, 2018

(86) PCT No.: PCT/KR2018/012236
§ 371 (c)(1),
(2) Date: Apr. 23, 2020

(87) PCT Pub. No.: WO2019/083214
PCT Pub. Date: May 2, 2019

(65) Prior Publication Data

US 2020/0248688 A1 Aug. 6, 2020

(30) Foreign Application Priority Data

Oct. 26, 2017 (DE) ..... 10 2017 125 096.4

(51) Int. Cl.
*F04C 18/02* (2006.01)
*C23F 1/02* (2006.01)
(Continued)

(52) U.S. Cl.
CPC ..... *F04C 18/0215* (2013.01); *C23F 1/02* (2013.01); *C23F 1/20* (2013.01); *C23F 1/36* (2013.01)

(58) Field of Classification Search
None
See application file for complete search history.

(56) References Cited

U.S. PATENT DOCUMENTS 5,037,281 A 8/1991 Lane et al.
6,146,774 A * 11/2000 Okamoto ..... C23C 18/36 384/625
(Continued)

FOREIGN PATENT DOCUMENTS

DE 4429911 B4 3/1995
DE 10250554 A1 5/2004
(Continued)

OTHER PUBLICATIONS

Aluminum Continuous Cast Rod; SHOTICTM Aluminum Powder Metal; SHORIKTM and Forged Products made from SHOTICTM /SHORIKTM http://donar.messe.de/exhibitor/hannovermesse/2017/U475910/shotic-brochure-eng-441028.pdf (Year: 2017).*
(Continued)

*Primary Examiner* — Allan W. Olsen
(74) *Attorney, Agent, or Firm* — Norton Rose Fulbright US LLP; James R. Crawford

(57) ABSTRACT

The invention relates to a method of manufacture of a scroll compressor (1), in particular for pretreatment for the coating of areas in contact with one another during operation of the scroll compressor (1). The scroll compressor (1) is developed with a non-movable spiral (3) with a base plate (3*a*) and a spiral-form wall (3*b*) extending from one side of the base plate (3*a*), as well as with a movable spiral (4) with a base plate (4*a*) and a spiral-form wall (4*b*) extending from a front side of the base plate (4*a*). The spirals (3, 4) are developed out of a basis material.

9 Claims, 6 Drawing Sheets

(51) Int. Cl.
*C23F 1/20* (2006.01)
*C23F 1/36* (2006.01)

(56) References Cited

U.S. PATENT DOCUMENTS

| | | | | |
|---|---|---|---|---|
| 6,162,343 | A * | 12/2000 | Takami | G11B 5/858 205/119 |
| 2002/0100694 | A1* | 8/2002 | Morin | C25D 5/44 205/170 |
| 2004/0060414 | A1* | 4/2004 | Sundqvist | A47J 43/0711 83/663 |
| 2006/0165544 | A1* | 7/2006 | Lettner | F04C 2/14 418/205 |
| 2007/0071994 | A1* | 3/2007 | Hayashida | C23C 28/023 428/650 |
| 2014/0205856 | A1* | 7/2014 | Jiang | A44C 21/00 428/650 |
| 2015/0118090 | A1 | 4/2015 | Lachey et al. | |
| 2018/0138135 | A1* | 5/2018 | Sunamoto | C23C 18/1844 |
| 2019/0066724 | A1* | 2/2019 | Nakamura | G11B 5/73913 |

FOREIGN PATENT DOCUMENTS

| | | | |
|---|---|---|---|
| EP | 1983195 | A1 | 10/2008 |
| JP | 2001304151 | A | 10/2001 |
| JP | 2006504892 | A | 2/2006 |
| JP | 2013170516 | A | 9/2013 |
| JP | 2015098794 | A | 5/2015 |
| JP | 2015528850 | A | 10/2015 |
| KR | 19980024272 | A | 7/1998 |
| KR | 20000064641 | A | 11/2000 |
| KR | 20080094340 | A | 10/2008 |
| KR | 20170086843 | A | 7/2017 |

OTHER PUBLICATIONS

International Search Report issued in PCT/KR2018/012236 dated Jan. 21, 2019.

* cited by examiner

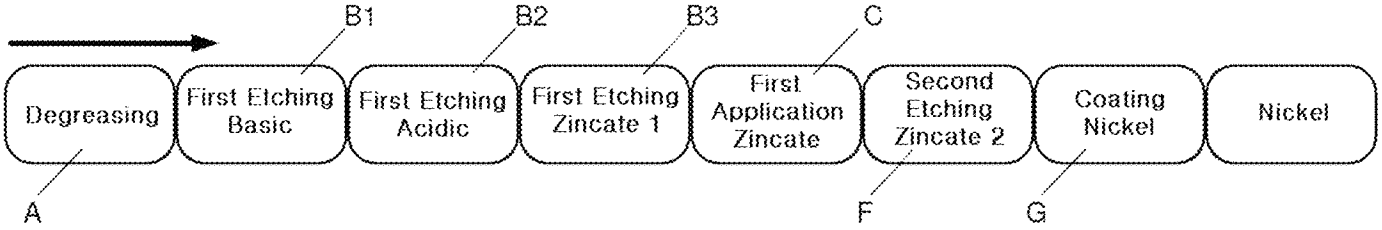
Fig, 2B

METHOD OF MANUFACTURE OF SCROLL COMPRESSORS AND SCROLL COMPRESSORS MANUFACTURED THEREBY

CROSS-REFERENCE TO RELATED APPLICATIONS

This application is the national phase under 35 U.S.C. § 371 of International Patent Application No. PCT/KR2018/012236 filed Oct. 17, 2018, which claims priority from German Patent Application No. DE 10 2017 125 096.4 filed Oct. 26, 2017, the entire content of each of which is incorporated herein by reference in its entirety.

FIELD OF THE INVENTION

The present invention relates to a method of manufacture of a scroll compressor, in particular for the coating pretreatment of areas contacting each other during the operation of the scroll compressor. The invention relates furthermore to a scroll compressor as a device for compressing a gaseous fluid, in particular a refrigerant, with at least one area that is pretreated and coated according to the method of manufacture of the scroll compressor.

BACKGROUND

Compressors known in prior art for mobile applications, in particular for climate control systems of motor vehicles, for conveying refrigerant through a refrigerant circulation, also denoted as refrigerant compressors, are often, independently of the refrigerant, developed as piston compressors with variable stroke displacement or as scroll compressors. The compressors are herein driven either by a belt pulley or electrically.

Conventional scroll compressors for refrigerants, such as R134a, R1234yf or R744, are employed in motor vehicles with hybrid drive and electric drive. Since the motor vehicles can drive without conventional, in particular combustion-engined, power units, the noise level, also denoted as NVH (Noise, Vibration, Harshness) level of the entire motor vehicle, is very low.

The NVH level comprises the vibrations audible as noise or perceptible as oscillations in the motor vehicle. The oscillations originate due to local force applications of an oscillation source into oscillation-transmitting media, such as mechanical structures in the motor vehicle. The oscillations resulting in the motor vehicle most frequently are generated out of self-excited friction oscillations (e.g. Stick-Slip) which are either side effects of intended friction or derive from unintended friction of solid bodies and lead to the radiation of structure-borne sound or audible air-borne sound. In order not to impair the traveling comfort of the passengers of the motor vehicle, these oscillations must be avoided and the NVH level of all components of the motor vehicle must be minimized.

The electrically actuated scroll compressor is conventionally operated in a range of approximately 600 revolutions per minute up to 10,000 revolutions per minute and has a high NVH level especially at operating modes of the refrigerant circulation that demand high rotary speeds of the compressor, such as in the mode for cooling an electric battery during charging.

Scroll compressors of prior art are developed with a fixed, non-movable stator and a movable orbiter, each with a spiral-form wall. The wall of the stator and the wall of the orbiter are disposed such that they interleave. During operation of the compressor the movable orbiter is pressed with a defined force against the non-movable stator.

Between the contacting walls several closed working volumes are developed, wherein the walls laterally delimit the working volumes. In addition, the working volumes are delimited at the contact faces of the front faces of the walls and, in each instance, at a surface, opposite to the front face of the wall, of a base plate of the stator or the orbiter. Due to the force pressing the movable orbiter against the non-movable stator, in particular the front face of the wall of the orbiter is pressed against the base plate of the stator in order to seal the working volumes.

The stator and the orbiter, also denoted as spirals or scrolls, are, inter alia, also subject to the requirements of friction reduction and wear as well as of cost-effective material selection with good stock removal characteristics for the working during manufacture. The essential challenge for the spirals lies therein that both components, in contact on one another and moved against each other, fit against one another such that they ensure a sealing function for the working volumes.

The sealing function is conventionally achieved using, for example, additional sealing elements which are disposed such that they are pressed against the front faces of the walls of the spirals, that is onto the spiral webs, and in counter-current with the surfaces of the base plate of the spirals disposed oppositely. The base plates of the spirals are herein protected by means of a steel sheet placed onto the surface.

U.S. Pat. No. 5,037,281 A discloses a scroll compressor with sealing elements for sealing the front faces of the walls of the fixed as well as of the movable spiral against the base plate of the spirals in each instance opposite to the wall. The sealing comprises a spring with C-shaped cross section, which is disposed within a groove developed in the front face of the wall. The spring is coated with a Teflon-based material. In the center of the spring is disposed an O-ring-shaped chloroprene-rubber sealing extending at least over a portion of the length of the spring in order to seal the core of the spring.

The utilization of the additional sealing elements causes additional costs as well as additional stock removal effort and assembly effort in the production of the spirals since the sealing elements are integrated or worked into the front faces of the spirals.

In order to counteract the additional high effort and complexity of providing the sealing elements, different material combinations and coatings are employed. The use of different materials, however, requires different stock removal processes as well as different coating processes, wherein the coating, at least of one of the components in contact on one another, is imperative.

In the case of operation of the refrigerant circulation developed with the scroll compressor in charging mode of the electric battery or frequently switched heat pump mode, an especially wear-resistant pairing of the materials of the spirals with respect to friction or wear is required. The coating processes necessary for this purpose entail very high costs. The use of different materials for the spiral pairing requires, moreover, different stock removal parameters and entails the risk of different thermal expansions of both components during operation.

Prior art also discloses providing differences in the height of the wall such that the front face [edge] of the wall of the spiral is not developed planarly or not parallel to the surface of the base plate.

SUMMARY

The problem addressed by the invention comprises providing a method of manufacturing spirals of a scroll compressor, in particular the development of the areas of the spirals that scrape against one another during operation of the compressor in order to ensure maximal service life of the compressor as a device for the compression of a gaseous fluid. The device is to comprise the least possible number of individual components and be constructionally simple as well as realizable with a minimum number of materials in order to minimize the costs specifically during the manufacture through an optimized fabrication process.

The problem is resolved through the method and the subject with the characteristics of the independent patent claims. Further developments are specified in the dependent patent claims.

The problem is resolved through a method according to the invention for manufacturing a scroll compressor, in particular for the pretreatment for coating of areas contacting one another during operation of the scroll compressor. The scroll compressor is herein, for one, developed with a non-movable spiral with a base plate and a spiral-form wall extending from one side of the base plate, as well as, for another, with a movable spiral with a base plate and a spiral-form wall extending from a front side of the base plate. The spirals are developed of a common basis material.

According to the concept of the invention, the method comprises the following steps:

- degreasing of the area to be coated of a surface of one of the two spirals,
- etching of the area using an alkaline etching agent,
- etching of the area using an acidic etching agent,
- first etching of the area using a zincate etchant,
- applying a zincate layer as an intermediate layer onto the area to be coated,
- further etching of the area using a zincate etchant, as well as
- coating the treated area using a coating material for closing off the surface.

By closing-off is to be understood a sealing-off of the surface, wherein the coating material represents a surface closed off with respect to the environs of the coated area of the spiral.

As a common basis material of the spirals an aluminum alloy, in particular AHS-7, is utilized to advantage.

According to a further development of the invention, the method comprises the following steps as intermediate steps between the application of a zincate layer and the further etching of the area with a zincate etchant:

- second etching of the area using an alkaline etching agent,
- second etching of the area using an acidic etching agent,
- second etching of the area using a zincate etchant and
- application of a second zincate layer as an intermediate layer onto the area to be coated.

As the common basis material of the spirals an aluminum alloy, in particular AlSi1MgMn is herein advantageously used.

According to an advantageous implementation of the invention, as the basis material of the spirals of the scroll compressor an aluminum alloy is utilized with a fraction of at least 9 mass percent up to 11 mass percent of silicon.

A further development of the invention comprises that exclusively one front face of the wall of the movable spiral is pretreated and coated.

For etching the area with an alkaline etching agent, a lye based on sodium hydroxide lye is preferably utilized, while for the etching of the area with an acidic etching agent, preferably nitric acid or hydrofluoric acid is utilized as the etching agent.

As the coating material nickel is advantageously employed.

According to a preferred implementation of the invention, the basis material is flushed using a flushing medium between the discrete steps of the etching. The flushing can herein take place only between selected steps of the etching or between all steps of the etching.

According to a further development of the invention, at least one area of a surface of the base plate of the fixed spiral is worked as the contacting area with the movable spiral. The method comprises herein the following additional steps:

- degreasing the area of the surface,
- etching the area using an alkaline etching agent,
- etching the area using an acidic etching agent,
- in conclusion, anodizing of the area.

The problem is furthermore resolved through a device according to the invention for the compression of a gaseous fluid, in particular of a refrigerant. The device comprises a non-movable spiral with a base plate and a wall, developed in spiral-form, extending from one side of the base plate of the non-movable spiral as well as a movable spiral with a base plate and a wall, developed in spiral-form, extending from one side of the base plate of the movable spiral with a free front face oriented distally to the base plate. The base plates are herein disposed with respect to one another such that the wall of the non-movable spiral and the wall of the movable spiral interleave and closed working volumes are developed. In reaction to a movement of the movable spiral, the volumes and the positions of the working volumes are varied. The spirals are developed out of a uniform basis material.

According to the concept of the invention, the front face of the wall of the movable spiral is disposed such that it is in contact directly on the base plate of the non-movable spiral under sealing. The front face of the wall of the movable spiral is herein developed with a coating of nickel.

By sealing and directly-contacting disposition of the front face of the wall of the movable spiral on the base plate of the non-movable spiral is to be understood a disposition and development of the spirals, in particular in the areas contacting one another, without intermediate elements, such as additional sealing elements or additional steel sheets disposed on the base plate.

A further development of the invention comprises that the front face of the wall of the movable spiral is developed as a planar surface and thus without different and discrepant heights of the wall of the spirals.

According to an advantageous implementation of the invention, the non-movable spiral as well as also the movable spiral are developed of a uniform aluminum alloy, in particular of AlSi1MgMn or AHS-7 as the basis material. The basis material preferably comprises a silicon fraction of at least 9 mass percent to 11 mass percent.

The front face of the wall of the movable spiral is advantageously developed such that it is pretreated and coated according to the method according to the invention for the manufacture of a scroll compressor.

In summary, the method according to the invention and the device according to the invention comprise further diverse advantages:

- relinquishment of additional steel sheets placed onto the surface of the base plate as well as relinquishment of additional sealing elements and thus decrease, for one, of the stock removal effort and of the assembly efforts of the spirals and, for another, decrease of the number of individual components, no modifications are necessary such as developing differences in the height of the wall of a spiral, the utilization of one basis material for both spirals enables, for one, a uniform stock removal process as well as a uniform coating process; for another, it effects the identical thermal expansion of both spirals during operation, which also increases the service life of the device and requires the utilization of only one basis material, the minimal number of individual components, and thus simple design engineering, as well as the utilization of one basis material lead to the optimization of the machine manufacture process and to the minimization of the costs and fabrication times for the manufacture, developing a wear protection layer on the basis material with optimal layer adhesion through the optimized pretreatment process, which minimizes the friction, the wear as well as the noise emission, in particular the NVH level, of the device and which also increases the service life of the device, the use of aluminum alloys, such as AlSi1MgMn and AHS-7, which moves under compression against the coated front face of the spiral, improves the operation of the device with dry-film lubricant, maximal service length of the device for the compression of a gaseous fluid, which, moreover, is developed for high pressure ranges of the fluid to be compressed.

BRIEF DESCRIPTION OF THE FIGURES

Further details, characteristics and advantages of implementations of the invention are evident based on the following description of embodiment examples with reference to the associated drawing. Therein depict:

FIG. 2B: a diagram of a method of pretreatment for coating a pair of spirals of the compression mechanism.

DETAILED DESCRIPTION OF AN EMBODIMENT

Figure 1:
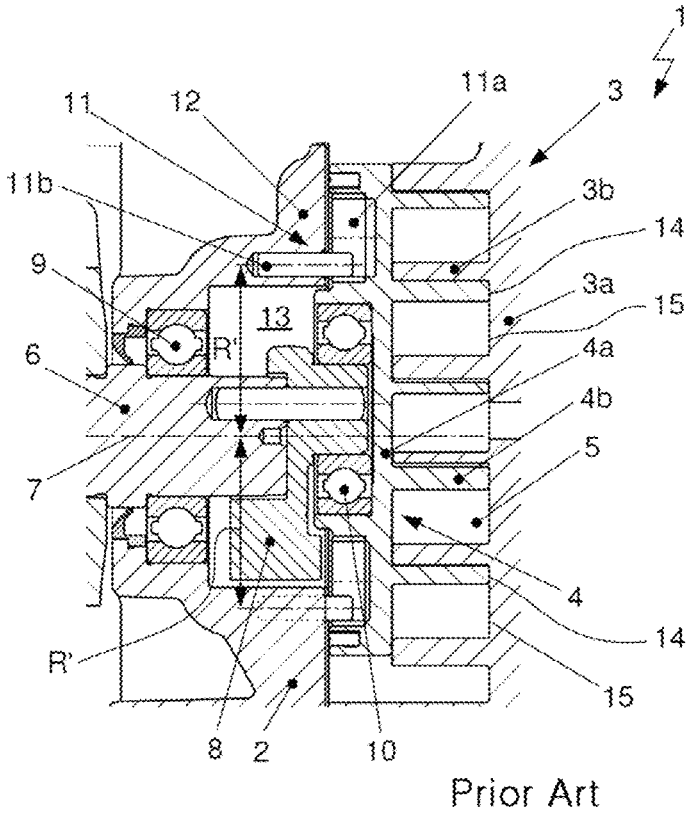
FIG. 1: a compression mechanism of a scroll compressor with a fixed and a movable spiral in lateral sectional representation of prior art.

In FIG. 1 is shown a scroll compressor 1 of prior art in a sectional representation. The scroll compressor 1 comprises a housing 2, a non-movable, fixed stator 3 with a disk-form base plate 3*a* and a wall 3*b*, developed in spiral form, extending from a side of the base plate 3*a*, as well as a movable orbiter 4 with a disk-form base plate 4*a* and a wall 4*b*, developed in spiral form, extending from a front side of the base plate 4*a*. Stator 3 and orbiter 4 which are also denoted in short as non-movable or fixed spiral 3 or respectively as movable spiral 4, cooperate. Herein the base plates 3*a*, 4*a* are disposed with respect to one another such that the wall 3*b* of stator 3 and the wall 4*b* of orbiter 4 interleave. The movable spiral 4 is moved by means of an eccentric drive along a circular path. During the movement of spiral 4 the walls 3*b*, 4*b* are in contact at several sites and within the walls 3*b*, 4*b* there are formed several successive closed working volumes 5, wherein adjacently disposed working volumes 5 delimit volumes of different size. As a response to the movement of orbiter 4, the volumes and the positions of the working volumes 5 are varied. The volumes of the working volumes 5 become increasingly smaller toward the center of the spiral-form walls 3*b*, 4*b* which are also denoted as spiral walls. The eccentric drive is formed of a drive shaft 6, rotating about a rotational axis 7, and an intermediate element 8. The drive shaft 6 is stayed on the housing 2 across a first bearing 9. The orbiter 4 is connected eccentrically with the drive shaft 6 across the intermediate element 8, which means the axis of the orbiter 4 and of the drive shaft 6 are disposed offset with respect to one another. The orbiter 4 is stayed on the intermediate element 8 across a second bearing 10.

The scroll compressor 1, moreover, comprises a guide device 11, comprised of a multiplicity of circular openings 11*a* as well as pins 11*b*, which prevent any rotation of the movable spiral 4 and enable the orbiting of the movable spiral 4. The openings 11 a, preferably developed as pocket bores, are developed in a back side of the base plate 4*a* of the movable spiral 4. The pins 11*b* are developed on a wall 12 of the housing 2 such that they project and each engages into an opening 11*a*.

As is furthermore evident in FIG. 1, the scroll compressor 1 comprises a wall 12, disposed within the housing 2 and fixed on housing 2, which is also denoted as counterwall 12. Between the counterwall 12 and the movable spiral 4 a counterpressure region 13 is developed. Due to the counterpressure obtaining within the counterpressure region 13, the movable spiral 4 is pressed with a force against the fixed spiral 3 which, like the counterwall 12, is also fixed on housing 2.

The working volumes 5 are laterally delimited, on the one hand, by the walls 3*b*, 4*b* in contact on one another of the spirals 3, 4. On the other hand, the working volumes 5 are sealed at the contact faces of the front face 14 of wall 4*b* of the movable spiral 4 and at the surface 15, oriented toward the working volumes 5, of the base plate 3*a* of the first spiral 3. Due to the force which presses the movable spiral 4 against the fixed spiral 3, the front face 14 of the wall 4*b* is pressed against the surface 15 of base plate 3*a* such that the working volumes 5 are sealed. The two spirals 3, 4 moved against one another under high axial loading are developed of the same basis material.

Figure 2A:
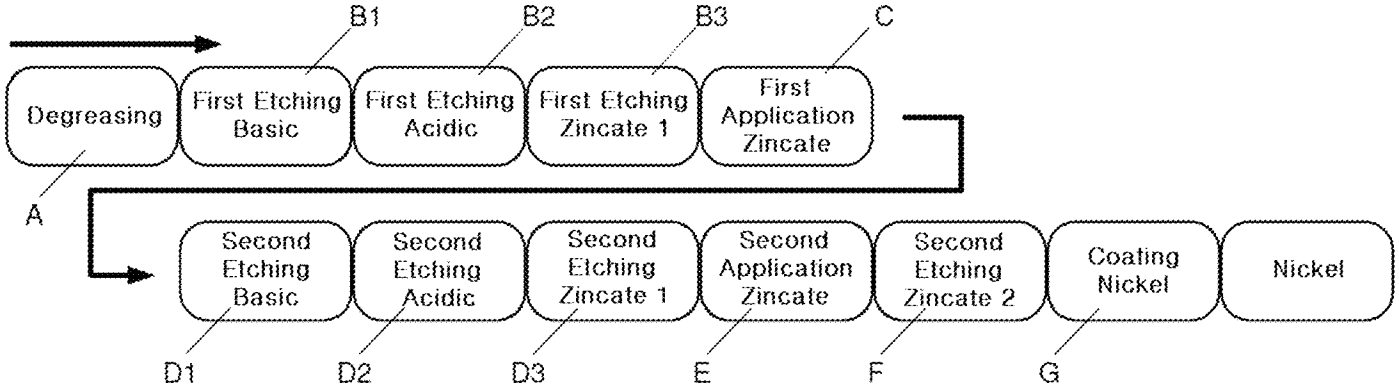
FIG. 2A: a diagram of a method of pretreatment for coating a pair of spirals of the compression mechanism.

FIG. 2A shows a diagram of a method of pretreatment for coating a pair of spirals 3, 4, in particular the front face 14 of wall 4*b* of the movable spiral 4, of a compression mechanism, as illustrated in FIG. 1.

FIG. 2B shows a diagram of a method of pretreatment for coating a pair of spirals 3, 4, in particular the front face 14 of wall 4*b* of the movable spiral 4, of a compression mechanism, as illustrated in FIG. 1.

The basis for both methods is in each instance an aluminum material as basis material of spirals 3, 4, which is also utilizable without a coating or without any additional surface treatment such that only one of the spirals 3, 4 is to be coated. Herein in each instance preferably the front face 14 of wall 4*b* of the movable spiral 4 is chemically nickel-plated, while the fixed spiral 3, in particular the surface 15 of base plate 3*a* of the fixed spiral 3 remains substantially without additional treatment and at least is not coated.

However, the particular basis material underlying the method comprises properties that enable good binding of the coating, requires a special pretreatment. In order to ensure optimal adhesion of the coating, in each case a method of pretreating for coating, in particular with regard to nickel, is carried out.

With the first method of pretreating for coating the basis material according to FIG. 2A, which is advantageously developed of an aluminum alloy AlSi1MgMn, EN AW-6082 for short, at least the area to be coated of the movable spiral 4 is degreased in the first step A and etched in the second step B.

A precondition for coating or galvanizing the basis material, for example with nickel, is the availability of a metallically clean surface. Since aluminum alloys develop a dense oxide layer in a very short time and coatings adhere not at all or only very poorly on oxide layers, the formation of the oxide layer must be avoided. To avoid the formation of the oxide layer and to generate a uniform surface, the surface to be coated is etched in a first substep B1 with a first etching agent that is basic or alkaline, in particular with lyes based on sodium hydroxide lye. In a second substep B2, the surface to be coated is subsequently etched with a second etching agent that is acidic, in particular nitric acid or hydrofluoric acid. The particular etching agents and etching conditions depend on the properties of the aluminum alloy, for example on the type of incorporations of foreign metals in the alloy. In a third substep B3, the surface to be treated is subjected to a first zincate etchant. With the zincate etchant the surface of the aluminum is activated and the natural oxide layer removed. In the etching process a thin natural oxide layer as a conductive intermediate layer is removed, which prevents the reoxidation of the surface by the time of the coating and enables or improves the adhesion of the coating.

After the substeps B1, B2, B3, in a third step C onto the surface to be coated an intermediate layer, in particular a first zincate layer, is applied. The zincate layer is to a large extent developed of zinc, however, it can also comprise other metals, such as copper, nickel or iron.

Depending on the basis material and zincate etchant, the first zincate layer applied in step C as a coating is to be removed in order to apply a second zincate layer and therewith to obtain a finer, denser structure. Herein method substeps B1, B2, B3, are repeated as method substeps D1, D2, D3. In the first substep D1 of the repeat etching of the surface to be coated, etching with the first etching agent, the etching process is carried out for the second time with basic or alkaline agents, in particular again with lyes based on sodium hydroxide lye. Subsequently, in a second substep D2 etching is carried with the second etching agent, an acidic agent, in particular with nitric acid or hydrofluoric acid. In the third substep D3 a second zincate etching is carried out on the surface to be coated before in a fifth step E a second intermediate layer, now a second zincate layer, is applied.

Subsequently, the basis material, in particular in the area of the surface to be coated, is subjected in a sixth step F to a repeat, and thus to a third, zincate etching and subsequently, in a seventh step G, is preferably coated with nickel. The coating can advantageously be carried out chemically and thus without electric current or currentless.

Between the discrete listed method steps, specifically between the discrete steps B1, B2, B3, D1, D2, D3, F of the etching process, the basis material is each time flushed with a flushing agent. The first method of pretreatment for coating the basis material according to FIG. 2A comprises a surface treatment that is carried out twice in order to effect very good adhesion of the nickel on the aluminum surface.

In addition, the aluminum alloy AlSi1MgMn, or EN AW-6-82, as the basis material of the fixed spiral 3, which is identical to the basis material of the movable spiral 4, is anodized at least on the surface 15 of the base plate 3*a* after the degreasing and etching, according to method steps A and the method substeps B1 as well as B2. The aluminum alloy is herein electrolytically oxidized, wherein through anodic oxidation a protective layer is generated. The uppermost aluminum layer of the area to be anodized is converted and an aluminum oxide is formed.

In the second method of pretreatment for coating the basis material according to FIG. 2B, which advantageously is developed of an aluminum alloy, for example also denoted as AHS-7, again, at least the area [to be] coated of the surface of the movable spiral 4, is degreased in a first step A and in the second step B treated with different etching agents before in the third step C an intermediate layer, in particular a first zincate layer, is applied. The method steps A to C with the substeps B1, B2, B3 correspond to the steps of the first method according to FIG. 2A.

In comparison to the first method, by using the aluminum alloy AHS-7 as specific basis material the method steps D to E, and therewith the [sub]steps D1, D2, D3 of the repeat etching processes as well as step E that involves applying a second zincate layer, are omitted.

After step C of applying the first zincate layer onto the surface to be coated, the basis material in step F is subjected to a second zincate etching as well as, in conclusion, in step G coated in particular with nickel, wherein the coating is advantageously carried out chemically.

In summary, the second method of pretreatment for coating at least the areas of the basis material according to FIG. 2B requires no special second surface treatment using multiple different etching processes and repeated application of a zincate layer in order to effect very good adhesion of the nickel on the aluminum surface. The method is consequently also denoted as 'simple method' of pretreatment for coating the basis material.

In addition, the fixed spiral 3, in comparison to the method of FIG. 2A, is not subjected to an additional surface treatment. The method according to FIG. 2B, moreover, requires lower employment of chemical substances and permits shorter throughput times of the workpieces.

Figure 3A:
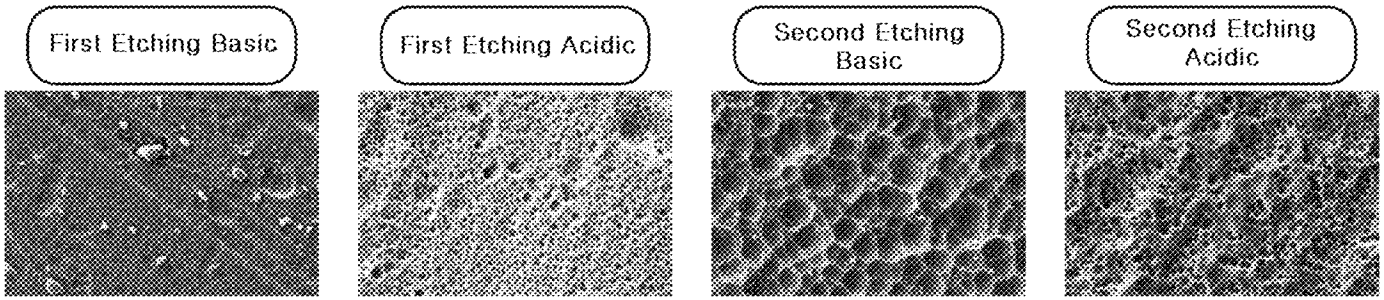
FIG. 3A: treated surfaces of the spiral after a step of the method from FIG. 2A.

FIG. 3A shows the treated surfaces of spirals 3, 4 after each method step B1, B2, D1, D2 of the method from FIG. 2A.

Figure 3B:
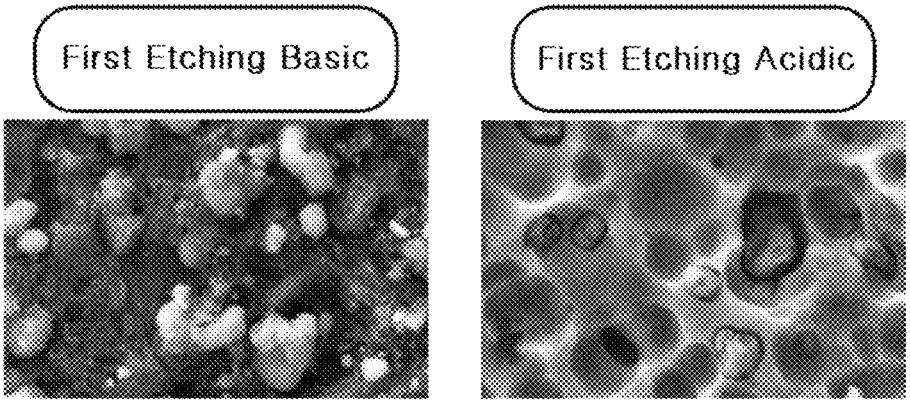
FIG. 3B: treated surfaces of the spiral after a step of the method from FIG. 2B.

FIG. 3B shows the treated surfaces of spirals 3, 4 after each method step B1, B2, D1, D2 of the method from FIG. 2B.

The surface treatment carried out twice of the first method of pretreatment for coating the basis material according to FIG. 2A with respect to the repetition of the method substeps B1, B2, B3 as method substeps D1, D2, D3, and therewith of the repeated etching of the surface to be coated with the alkaline etching agent, the acid etching agent as well as the zincate etchant and each subsequent application of the zincate layer effects primarily a greater roughness of the surface to be coated. As a consequence of the greater roughness, the surface has a greater number of adhesion sites or fixing points for a very good adhesion of the nickel on the aluminum surface. As is evident in FIG. 3A, the roughness, and therewith the number of adhesion sites, increase markedly with increasing method progression and repeated etching.

In comparison to FIG. 3A, in FIG. 3B can be seen that in the second method of pretreatment for coating the basis material, in particular the aluminum alloy AHS-7 according to FIG. 2B, with respect to the steps of etching, a simple treatment suffices to attain a surface roughness necessary for coating. As a comparison of FIGS. 3A and 3B shows, with the simple treatment of the surface of the aluminum alloy AHS-7 according to FIG. 2B after the first etching with an acidic etching agent a surface with a roughness can be generated that is similar to that obtained with the twice completed treatment of the surface of the aluminum alloy AlSi1MgMn according to FIG. 2A after the second etching with the acidic etching agent. The methods for pretreatment for coating the particular basis material are herein matched to the particular basis material in order to ensure optimal adhesion of the coating.

In each instance the basis materials comprise a high fraction of silicon which determine the tribological behaviour with respect to wear by friction and the lubrication of the system.

Figure 4:
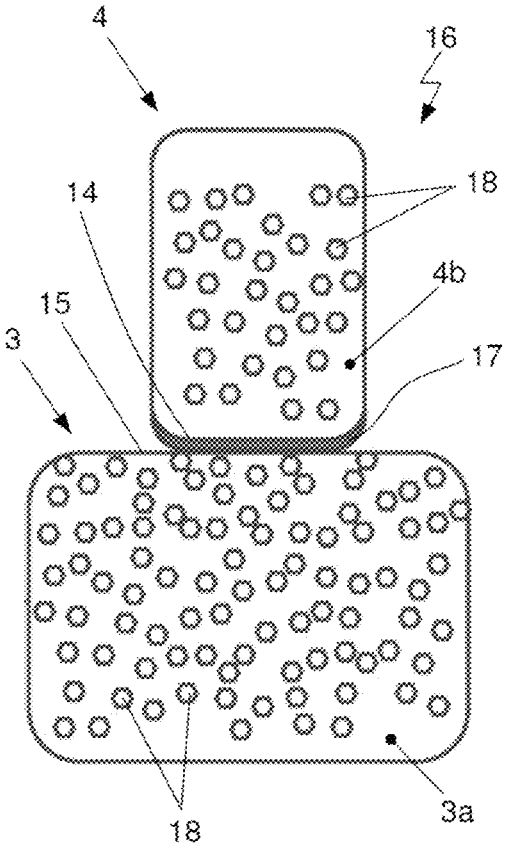
FIG. 4: schematic diagram of a pair of spirals scraping against one another in a sectional representation as well as FIG. 5: representation of the noise emission of the scroll compressor as a function of the rotary speed of the compression mechanism.

In FIG. 4 a schematic diagram of a tribological pairing 16 of spirals 3, 4 scraping against one another is shown in sectional representation. The movable spiral 4 is disposed such that it is in contact at the front face 14 of wall 4*b* on the surface 15 of base plate 3*a* of the fixed spiral 3. The contact face is provided with the coating 17 which is preferably developed as a nickel layer. Spirals 3, 4 are developed of identical basis material.

The high fraction of silicon in the form of minuscule silicon elements 18 within the basis material fulfills the function of sliding elements that cooperate with the nickel of the coating 17.

Figure 5:
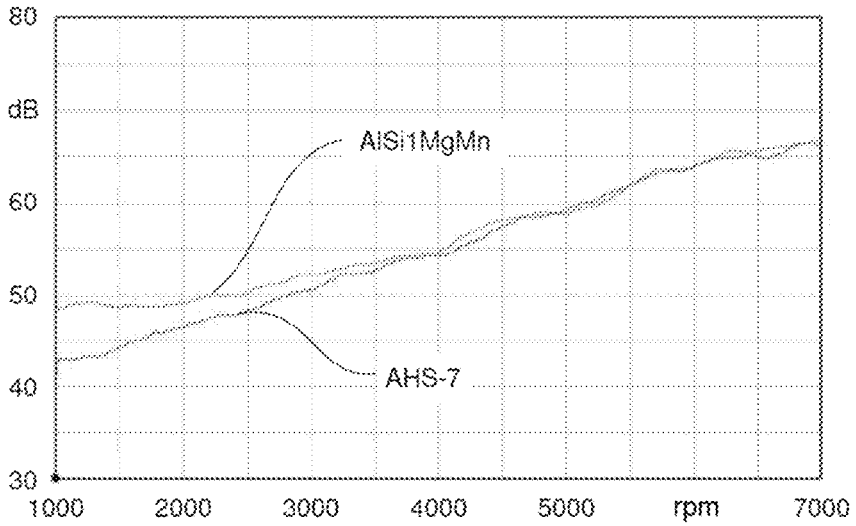

In FIG. 5 is evident a depiction of the noise emission of scroll compressor 1 as a function of the rotary speed of the compression mechanism. For one, the spirals 3, 4 are each developed of aluminum alloy AlSi1MgMn or AHS-7. For another, the spirals 3, 4 produced of the basis material AlSi1MgMn were worked with the first method of pretreatment for coating with steps A to G according to FIG. 2A, and the spirals 3, 4 produced of the basis material AHS-7 were worked with the second method of pretreatment for coating with steps A to G according to FIG. 2B.

The scroll compressor 1 with the spirals 3, 4 of the basis material AHS-7 and worked with the method of pretreatment for coating according to FIG. 2B has, in particular in the range of rotary speeds up to approximately 3000 RPM, and thus during the startup of the scroll compressor 1, a lower overall noise level than the scroll compressor 1 with spirals 3, 4 developed of basis material AlSi1MgMn and worked with the method of pretreatment for coating according to FIG. 2A.

The invention claimed is:

1. A method of manufacture of a scroll compressor, in particular of the pretreatment for the coating of areas in contact with one another during operation of the scroll compressor, wherein the scroll compressor is developed with a non-movable spiral with a base plate and a spiral-form wall, extending from one side of the base plate, as well as with a movable spiral with a base plate and a spiral-form wall extending from a front side of the base plate and the spirals are developed out of a basis material, the method comprising the following steps:

degreasing of an area to be coated of a surface of one of the spirals, etching of the area using an alkaline etching agent, etching of the area using an acidic etching agent, first etching of the area using a zincate etchant containing zinc, application of a zincate layer containing zincate as intermediate layer onto the area to be coated, further etching of the area using a zincate etchant containing zinc, and coating of the treated area using a coating material closing off the surface, wherein etching of the area using an alkaline etching agent, etching of the area using an acidic etching agent, and first etching of the area using a zincate etchant containing zinc are provided before application of the zincate layer containing zincate as intermediate layer onto the area to be coated;

further comprising the following steps as intermediate steps between the application of the zincate layer and the further etching of the area using the zincate etchant:

second etching of the area using an alkaline etching agent, second etching of the area using an acidic etching agent, second etching of the area using a zincate etchant containing zinc, and application of a second zincate layer comprising zincate as an intermediate layer onto the area to be coated.

2. A method according to claim 1, wherein the basis material comprises aluminum alloy AlSi1MgMn.

3. A method according to claim 1, wherein the basis material comprises an aluminum alloy with a fraction of at least 9 mass percent to 11 mass percent of silicon.

4. A method according to claim 3, wherein exclusively one front face of the wall of the movable spiral is pretreated for coating and coated.

5. A method according to claim 4, wherein the alkaline etching agent comprises a lye based on sodium hydroxide lye.

6. A method according to claim 5, wherein the acidic etching agent comprises nitric acid or hydrofluoric acid.

7. A method according to claim 6, wherein the basis material is flushed with a flushing agent between each of the etching steps.

8. A method according to claim 7, wherein at least one area of a surface of the base plate of the fixed spiral is worked and the method comprises the steps of:

degreasing of the area of the surface, etching of the area using an alkaline etching agent, etching of the area using an acidic etching agent, and anodizing of the area.

9. A method according to claim 1, wherein the coating material comprises nickel.

* * * * *